US012053663B2

(12) United States Patent
Lin

(10) Patent No.: US 12,053,663 B2
(45) Date of Patent: Aug. 6, 2024

(54) TRANSMISSION STRUCTURE OF CLIMBING MACHINE

(71) Applicant: Tsung-Chou Lin, Tainan (TW)

(72) Inventor: Tsung-Chou Lin, Tainan (TW)

(73) Assignee: Chih-Yung Hsu, Tainan (TW)

( * ) Notice: Subject to any disclaimer, the term of this patent is extended or adjusted under 35 U.S.C. 154(b) by 299 days.

(21) Appl. No.: 17/670,795

(22) Filed: Feb. 14, 2022

(65) Prior Publication Data

US 2023/0233899 A1 Jul. 27, 2023

(30) Foreign Application Priority Data

Jan. 24, 2022 (TW) ..... 111200954

(51) Int. Cl.
*A63B 21/00* (2006.01)
*A63B 22/00* (2006.01)
*A63B 22/20* (2006.01)

(52) U.S. Cl.
CPC ..... *A63B 21/154* (2013.01); *A63B 21/4034* (2015.10); *A63B 21/4035* (2015.10); *A63B 21/4045* (2015.10); *A63B 22/001* (2013.01); *A63B 22/205* (2013.01)

(58) Field of Classification Search
CPC . A63B 21/0051; A63B 21/151; A63B 21/154; A63B 21/4034; A63B 21/4035; A63B 21/4045; A63B 22/001; A63B 22/205
See application file for complete search history.

(56) References Cited

U.S. PATENT DOCUMENTS 5,040,785 A * 8/1991 Charnitski ..... A63B 23/0417 482/52
5,492,515 A * 2/1996 Charnitski ..... A63B 22/001 482/37
11,077,336 B2 * 8/2021 Carruthers ..... A63B 21/4035
11,235,197 B2 * 2/2022 Carruthers ..... A63B 22/04
11,285,362 B2 * 3/2022 Carruthers ..... A63B 22/04
11,291,882 B2 * 4/2022 Carruthers ..... A63B 22/0046
11,305,154 B2 * 4/2022 Carruthers ..... A63B 22/04
11,324,993 B2 * 5/2022 Carruthers ..... A63B 22/04
11,426,622 B2 * 8/2022 Carruthers ..... A63B 71/0622
(Continued)

FOREIGN PATENT DOCUMENTS

TW I656899 B 4/2019
TW M578599 U 6/2019

*Primary Examiner* — Joshua Lee
(74) *Attorney, Agent, or Firm* — Rosenberg, Klein & Lee

(57) ABSTRACT

A transmission structure of a climbing machine for an operator to operate in a standing position is disclosed. The transmission structure of the climbing machine includes a base, a support frame, a first slide rail, a second slide rail, a first transmission unit, a second transmission unit, a first handle slider, a first pedal slider, a second handle slider, a second pedal slider, and a resistance unit. The climbing machine is used to train the synchronized and coordinated movements of hands and feet for simulating rock climbing and mountaineering. The support frame, the first slide rail, the second slide rail, the first transmission unit and the second transmission unit are all located at the center line position of the upright trunk of the operator. The volume of the climbing machine can be reduced greatly to save the space occupied.

10 Claims, 16 Drawing Sheets

(56) References Cited

U.S. PATENT DOCUMENTS

| | | | | |
|---|---|---|---|---|
| 11,452,907 | B2 * | 9/2022 | Carruthers | A63B 22/001 |
| 2021/0387044 | A1 * | 12/2021 | Carruthers | A63B 71/0622 |
| 2021/0387045 | A1 * | 12/2021 | Carruthers | A63B 22/0046 |
| 2021/0387046 | A1 * | 12/2021 | Carruthers | A63B 22/04 |
| 2021/0387048 | A1 * | 12/2021 | Carruthers | A63B 21/4035 |
| 2021/0387049 | A1 * | 12/2021 | Carruthers | A63B 71/0622 |
| 2021/0387050 | A1 * | 12/2021 | Carruthers | A63B 21/00069 |
| 2021/0387051 | A1 * | 12/2021 | Carruthers | A63B 21/4045 |
| 2021/0394015 | A1 * | 12/2021 | Carruthers | A63B 21/4034 |
| 2021/0394016 | A1 * | 12/2021 | Carruthers | A63B 22/04 |
| 2021/0394018 | A1 * | 12/2021 | Carruthers | A63B 22/205 |
| 2022/0016476 | A1 * | 1/2022 | Carruthers | A63B 21/4034 |
| 2022/0016477 | A1 * | 1/2022 | Carruthers | A63B 21/00069 |
| 2022/0395735 | A1 * | 12/2022 | Sun | A63B 22/0005 |

* cited by examiner

TRANSMISSION STRUCTURE OF CLIMBING MACHINE

FIELD OF THE INVENTION

The present invention relates to a transmission structure of a climbing machine, and more particularly to a transmission structure that is suitable for a climbing machine without slipping and producing noise when running.

BACKGROUND OF THE INVENTION

Due to the limitation of outdoor venues and climate, in order to enhance indoor sports and fitness, a climbing machine is used for simulating rock climbing and mountaineering, so that the user can practice the coordinated movements of hands and feet effectively for rock climbing and mountaineering, achieving the sports and fitness effect.

Taiwan Patent No. 1656899 discloses a rock climbing machine, published on Apr. 21, 2019, comprising a resistance device, a driving device, and two climbing devices. The driving device includes an upper wheel unit, an axle wheel unit and a lower wheel unit. The axle wheel unit includes a first axle wheel and a second axle wheel. Through a plurality of connecting members, the up and down movement of the climbing devices drives the upper wheel unit and the lower wheel unit to rotate in a first direction. The upper wheel unit drives the first axis wheel to rotate in a second direction. The lower wheel unit drives the second axis wheel to rotate in the first direction.

In the above patent, the transmission is implemented by chains and gears. Because the chain drive requires frequent lubrication and maintenance, it is easy to generate vibration and noise. Besides, the transmission speed is not uniform, and the operation process is unstable.

Taiwan Utility Model No. M578599 discloses a rock climbing machine capable of adjusting an angle, published on Jun. 1, 2019, comprising a chassis unit, a slide rod unit, a resistance unit and a lift frame unit. The chassis unit includes a base frame that is suitable for being placed on a setting surface and a vertical frame that is disposed on the base frame at an angle relative to the setting surface. The slide rod unit includes two slide rods, two grips respectively disposed on the slide rods, and two pedals respectively disposed on the slide rods. The resistance unit is arranged on the chassis unit and provides a resistance when the pedals are moved. The lift frame unit has a first end portion disposed on the chassis unit and a second end portion that can be placed on the setting surface. The lift frame unit can be operated to change the distance between the first end portion and the second end portion, so as to adjust the angle between the extension direction of the vertical frame and the setting surface, thereby meeting various training needs and saving space and cost.

In the above patent, the transmission is implemented by belts and pulleys. Because the belt drive is easy to slip, there will be slippage in the transmission. An accurate transmission ratio cannot be obtained. The aging is fast and the power transmission efficiency is poor. It is not ideal for use.

SUMMARY OF THE INVENTION

In order to solve the above-mentioned shortcomings, the primary object of the present invention is to provide a transmission structure of a climbing machine for an operator to operate in a standing position, comprising a base, a support frame, a first slide rail, a second slide rail, a first transmission unit, a second transmission unit, a first handle slider, a first pedal slider, a second handle slider, a second pedal slider and a resistance unit. The support frame is vertically disposed on the base. The support frame is located between both legs of the operator. The support frame includes a first side and a second side. The first slide rail is disposed on the first side. The second slide rail is disposed on the second side. The first transmission unit is disposed on the first side. The first transmission unit includes a first upper transmission wheel, a first lower transmission wheel, and a first transmission member. The first upper transmission wheel is disposed at one end of the support frame. The first lower transmission wheel is disposed at another end of the support frame. The first transmission member is looped around the first upper transmission wheel and the first lower transmission wheel. The first transmission member includes a first near section close to the operator and a first far section away from the operator. The second transmission unit is disposed on the second side. The second transmission unit includes a second upper transmission wheel, a second lower transmission wheel, and a second transmission member. The second upper transmission wheel corresponds to the first upper transmission wheel and is disposed at one end of the support frame. The second lower transmission wheel corresponds to the first lower transmission wheel and is disposed at the other end of the support frame. The second transmission member is looped around the second upper transmission wheel and the second lower transmission wheel. The second transmission member includes a second near section close to the operator and a second far section away from the operator. The first transmission unit and the second transmission unit act synchronously. A first handle is connected to the first handle slider. The first handle slider is configured to slide on the first slide rail. The first handle slider is connected to the first far section. A first pedal is connected to the first pedal slider. The first pedal slider is configured to slide on the first slide rail. The first pedal slider is connected to the first near section. A second handle is connected to the second handle slider. The second handle slider is configured to slide on the second slide rail. The second handle slider is connected to the first near section. A second pedal is connected to the second pedal slider. The second pedal slider is configured to slide on the second slide rail. The second pedal slider is connected to the second far section. The resistance unit is disposed on the base or the support frame. The resistance unit is connected to the first transmission unit or/and the second transmission unit for providing a resistance to the first transmission unit or/and the second transmission unit.

Preferably, the first upper transmission wheel, the first lower transmission wheel, the second upper transmission wheel and the second lower transmission wheel each are a timing belt pulley, a gear, a belt pulley or a cable wheel.

Preferably, the first transmission member and the second transmission member each are a timing belt, a chain, a belt or a cable.

Preferably, the first slide rail includes a first near slide rail and a first far slide rail. The first near slide rail is arranged on the support frame at a position close to the operator. The first pedal slider slides on the first near slide rail. The first far slide rail is arranged on the support frame at a position away from the operator. The first handle slider slides on the first far slide rail. The second slide rail includes a second near slide rail and a second far slide rail. The second near slide rail is arranged on the support frame at a position close to the operator. The second pedal slider slides on the second near slide rail. The second far slide rail is arranged on the support frame at a position away from the operator. The second handle slider slides on the second far slide rail.

Preferably, the first handle slider is provided with a first handle connecting block. The first handle connecting block is connected to the first far section. The first pedal slider is provided with a first pedal connecting block. The first pedal connecting block is connected to the first near section. The second handle slider is provided with a second handle connecting block. The second handle connecting block is connected to the first near section. The second pedal slider is provided with a second pedal connecting block. The second pedal connecting block is connected to the second far section.

Preferably, the first upper transmission wheel and the second upper transmission wheel are connected to an upper shaft. The upper shaft is connected to the support frame. The first upper transmission wheel and the second upper transmission wheel are rotatably disposed on the upper shaft, respectively. The first lower transmission wheel and the second lower transmission wheel are jointly connected to a lower shaft. The lower shaft is rotatably connected to the support frame, so that the first lower transmission wheel and the second lower transmission wheel are rotated back and forth synchronously along with the lower shaft.

Preferably, an axis line between an upper shaft axis of the upper shaft and a lower shaft axis of the lower shaft divides the first transmission member into the first near section and the first far section, and the axis line divides the second transmission member into the second near section and the second far section.

Preferably, the resistance unit includes a driving wheel, a driven wheel, a resistance wheel, a magnetic resistance member, a first belt, and a second belt. The driving wheel is connected to the lower shaft and rotates back and forth synchronously along with the lower shaft. The driven wheel and the resistance wheel are relatively connected to the base. The first belt is looped around the driving wheel and the driven wheel. The second belt is looped around the driven wheel and the resistance wheel. The magnetic resistance member is rotatably disposed on the support frame to exert the resistance on the resistance wheel. The resistance wheel transmits the resistance through the second belt, the driven wheel, the first belt and the driving wheel. The resistance is transmitted to the first handle, the first pedal, the second handle, and the second pedal through the first transmission member and the second transmission member.

Preferably, an auxiliary frame is provided at one end of the support frame away from the base. The auxiliary frame is provided with an auxiliary handle at a position close to the operator. The auxiliary frame is provided with a display unit at a position away from the operator. The first handle has a first handle upper section. The second handle has a second handle upper section. A distance between the first handle upper section and the second handle upper section is greater than a width of the display unit.

Preferably, the first handle slider, the second handle slider, the first pedal slider and the second pedal slider are respectively provided with at least one roller, and the roller slides on the first slide rail or the second slide rail.

Alternatively, the first handle slider, the second handle slider, the first pedal slider and the second pedal slider are respectively provided with at least one bushing, and the bushing slides on the first slide rail or the second slide rail.

The above-mentioned technical features have the following advantage:

1. The support frame, the first slide rail, the second slide rail, the first transmission unit and the second transmission unit are all located at the center line position of the upright trunk of the operator. The volume of the climbing machine can be reduced greatly to save the space occupied.
2. The first pedal slider is connected to the first near section of the first transmission member, and the first handle slider is connected to the first far section, so that the left foot and the left hand of the operator move away from each other or approach each other in operation. The second pedal slider is connected to the second far section of the second transmission member, and the second handle slider is connected to the first near section of the first transmission member, so that the right foot and the right hand of the operator move away from each other or approach each other in operation. Because the second handle slider located on the second side is connected to the first near section of the first side by bypassing the second far section and the second near section, the second handle slider always moves synchronously in the same direction as the first pedal slider at any time during the operation. The first handle slider is connected to the first far section, and the second pedal slider is connected to the second far section of the second transmission member. Therefore, the first handle slider and the second pedal slider also act synchronously in the same direction. That is, during the operation, the left foot and the left hand of the operator always move away from each other and approach each other. The right foot and the right hand of the operator always move away from each other and approach each other. The right hand and the left foot of the operator are synchronized in the same direction. The left hand and the right foot of the operator are synchronized in the same direction.
3. Through the meshing transmission of the timing belt and the timing belt pulley, the transmission accuracy can be achieved. In addition, the operation process is stable, without slippage and vibration. It is quiet and low-noise, with accurate transmission effect and better power transmission efficiency.

DESCRIPTION OF THE PREFERRED EMBODIMENTS

Embodiments of the present invention will now be described, byway of example only, with reference to the accompanying drawings.

Figure 1:
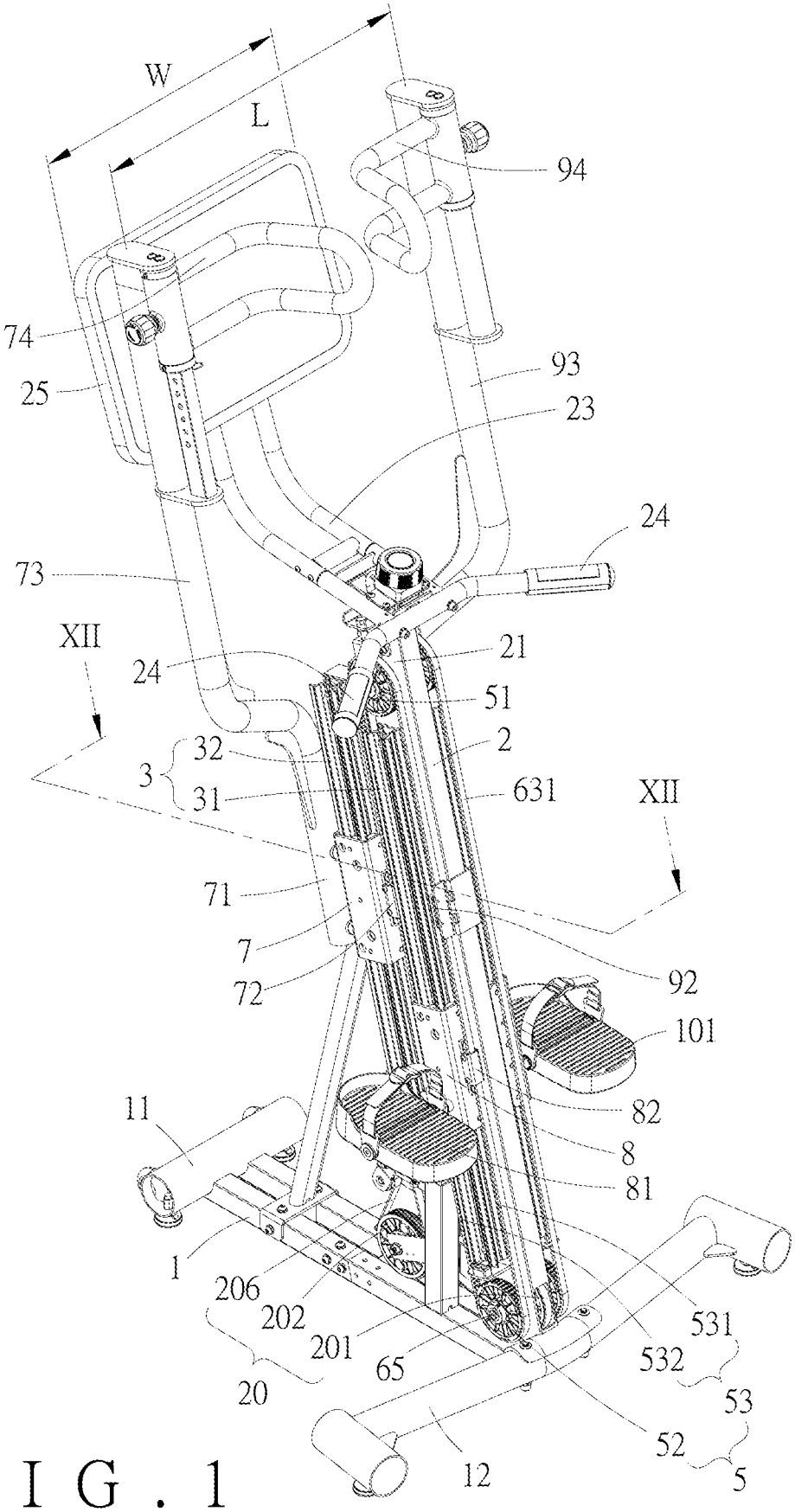
FIG. 1 is a perspective view according to an embodiment of the present invention.
Figure 2:
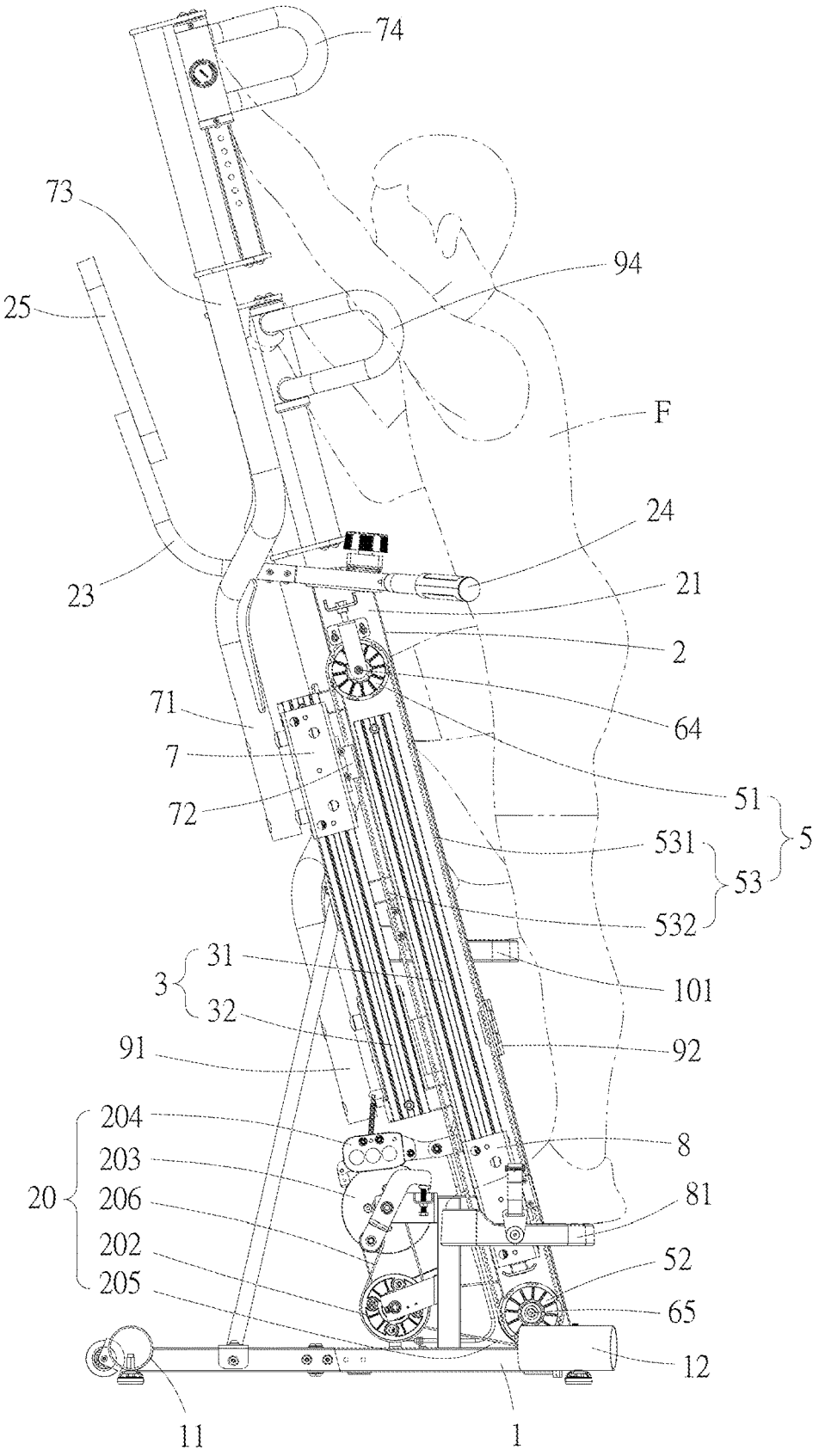
FIG. 2 is a side view according to the embodiment of the present invention when in use.
Figure 3:
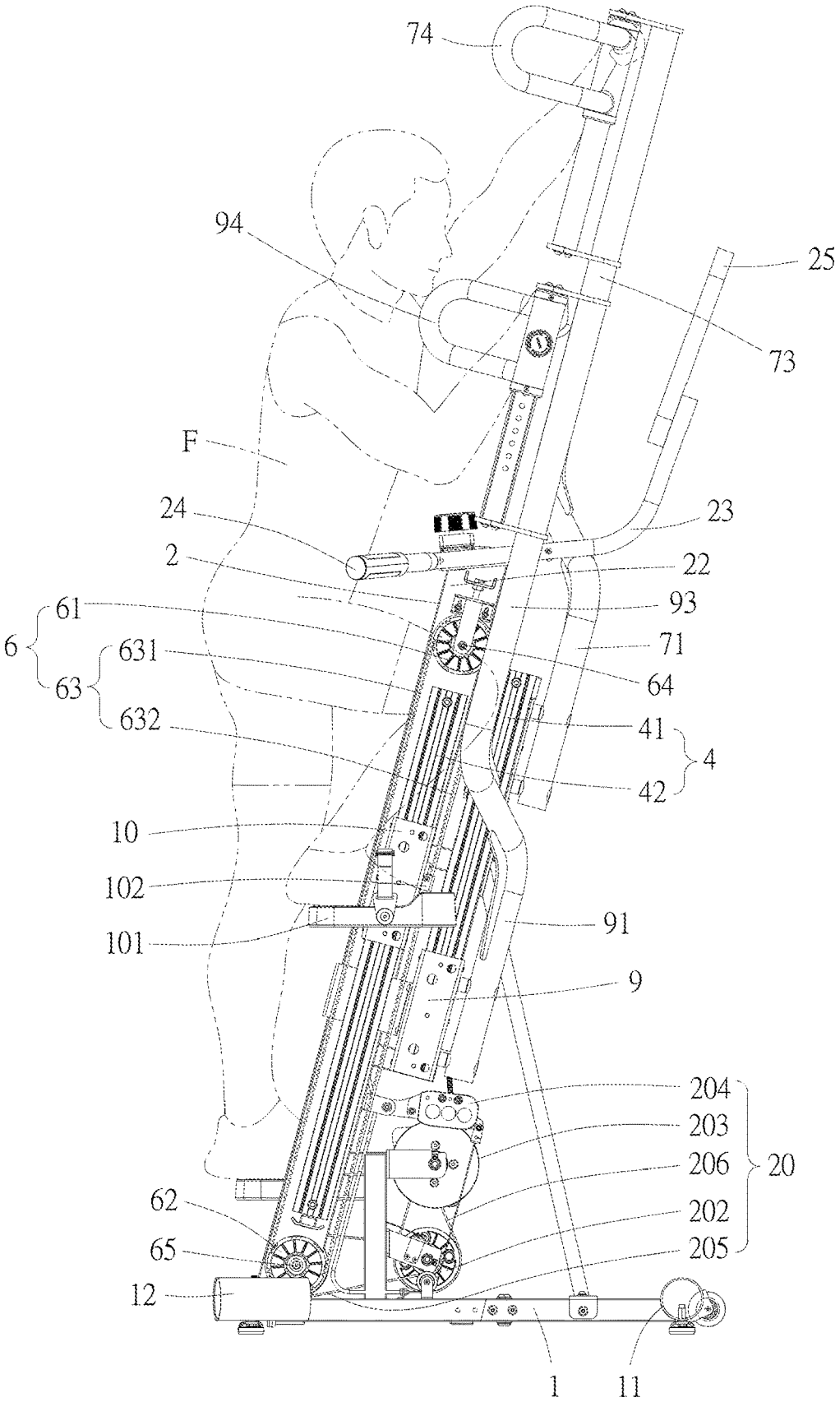
FIG. 3 is another side view according to the embodiment of the present invention when in use.

As shown in FIG. 1, FIG. 2 and FIG. 3, the present invention discloses a transmission structure of a climbing machine for an operator F to operate in a standing position. The transmission structure of the climbing machine comprises a base 1, a support frame 2, a first slide rail 3, a second slide rail 4, a first transmission unit 5, a second transmission unit 6, a first handle slider 7, a first pedal slider 8, a second handle slider 9, a second pedal slider 10, and a resistance unit 20.

The base 1 has a first support rod 11 and a second support rod 12 opposite to the first support rod 11, so as to be stably supported on a flat surface, such as the ground. However, the base 1 may be in other shapes, not limited to this embodiment.

The support frame 2 is vertically disposed on the base 1. The support frame 2 is located between both legs of the operator F. The support frame 2 includes a first side 21 and a second side 22. As shown in FIG. 2 and FIG. 3, the first side 21 is located on the left side and the second side 22 is located on the right side when the operator F operates the climbing machine. An auxiliary frame 23 is provided at one end of the support frame 2 away from the base 1. The auxiliary frame 23 is provided with an auxiliary handle 24 at a position close to the operator F. The auxiliary frame 23 is provided with a display unit 25 at a position away from the operator F. The display unit 25 is configured to display sports information, entertainment information, teaching information or network information.

The first slide rail 3 is disposed on the first side 21. The first slide rail 3 includes a first near slide rail 31 and a first far slide rail 32. The first near slide rail 31 is arranged on the support frame 2 at a position close to the operator F. The first far slide rail 32 is arranged on the support frame 2 at a position away from the operator F.

The second slide rail 4 is disposed on the second side 22. The second slide rail 4 includes a second near slide rail 41 and a second far slide rail 42. The second near slide rail 41 is arranged on the support frame 2 at a position close to the operator F. The second far slide rail 42 is arranged on the support frame 2 at a position away from the operator F.

Figure 4:
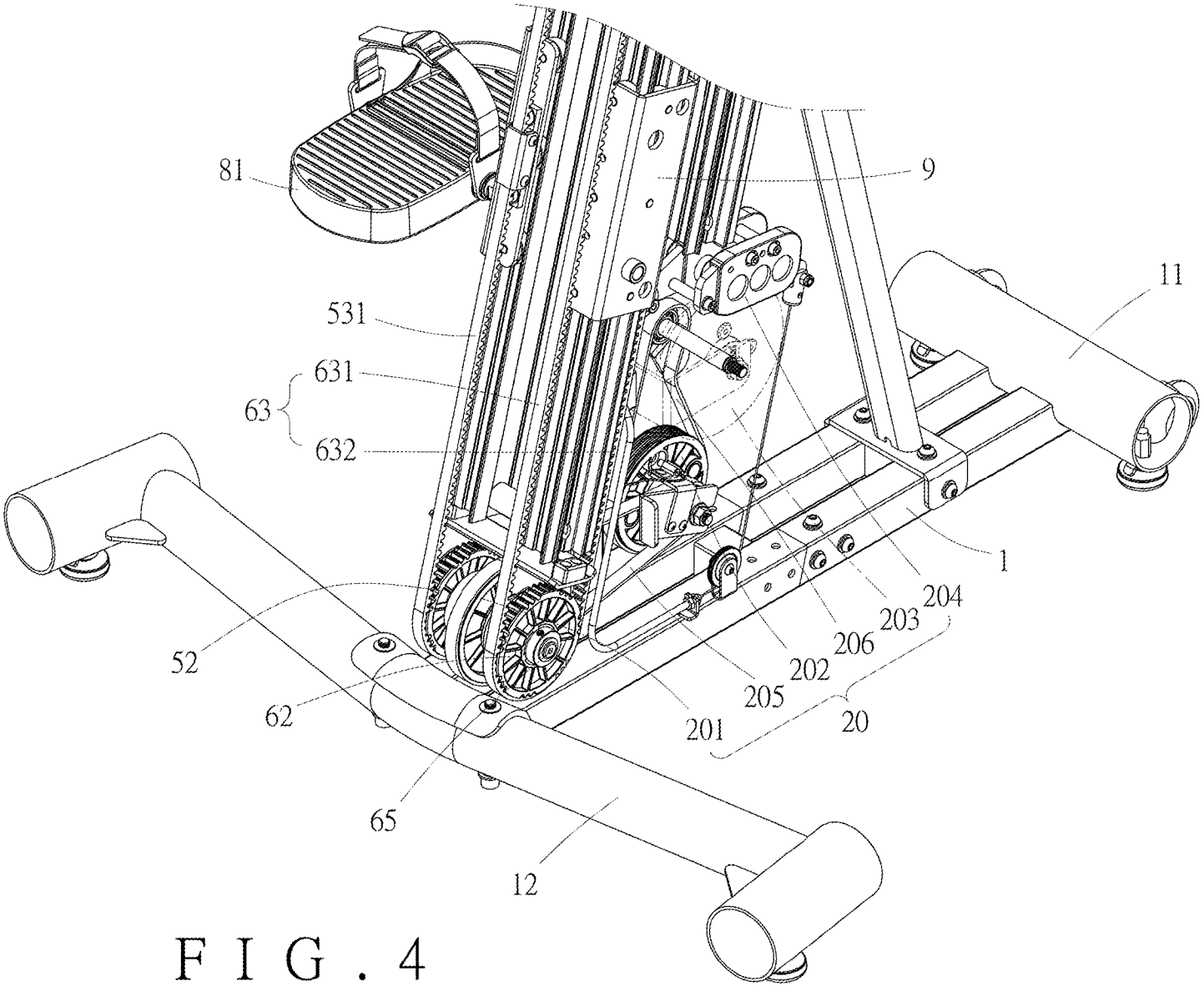
FIG. 4 is a structural schematic view of the resistance unit according to the embodiment of the present invention.
Figure 5:
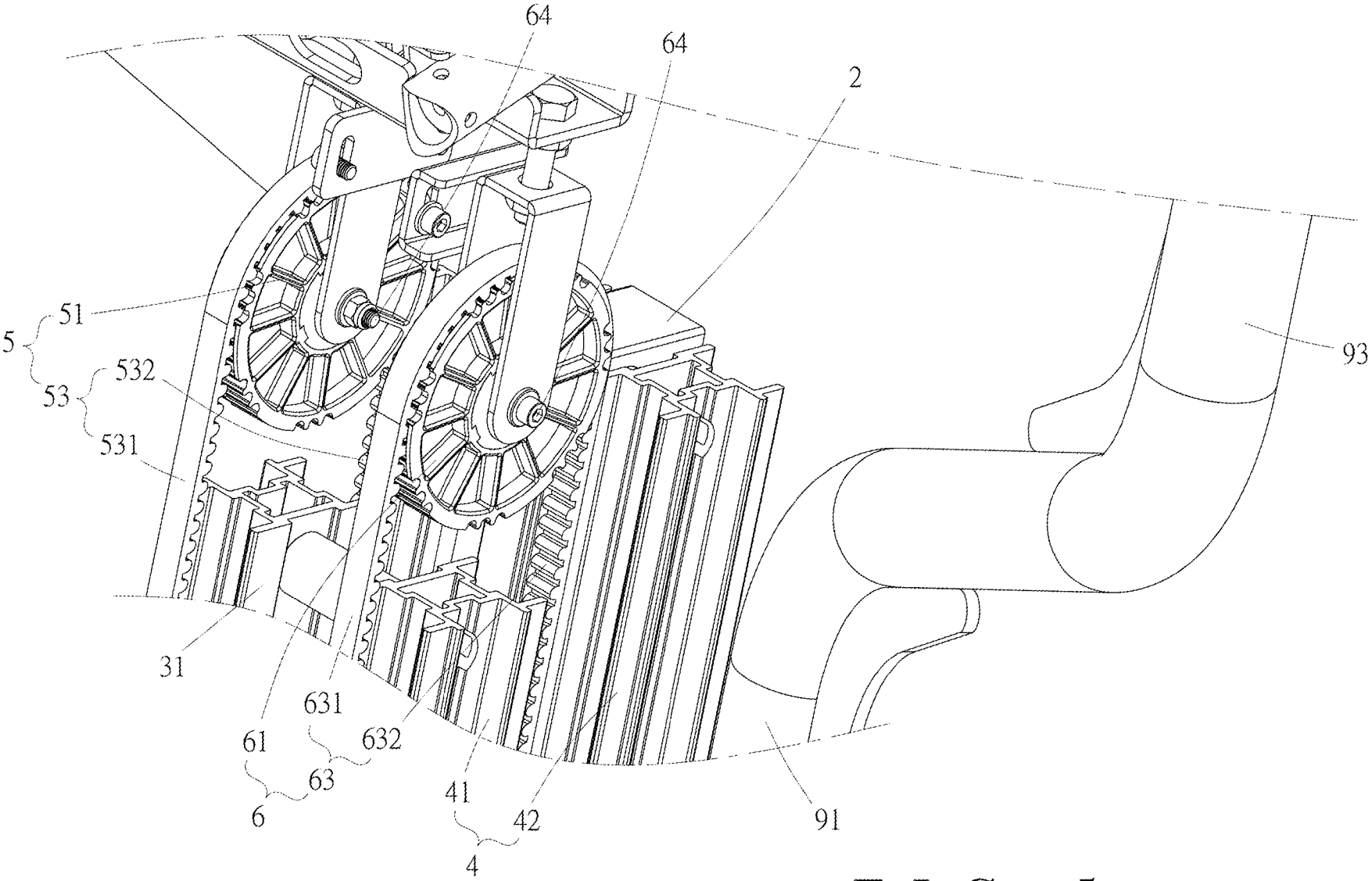
FIG. 5 is a schematic view of the first upper transmission wheel and the second upper transmission wheel meshing with the first transmission member and the second transmission member respectively according to the embodiment of the present invention, wherein the support frame is not shown.
Figure 5A:
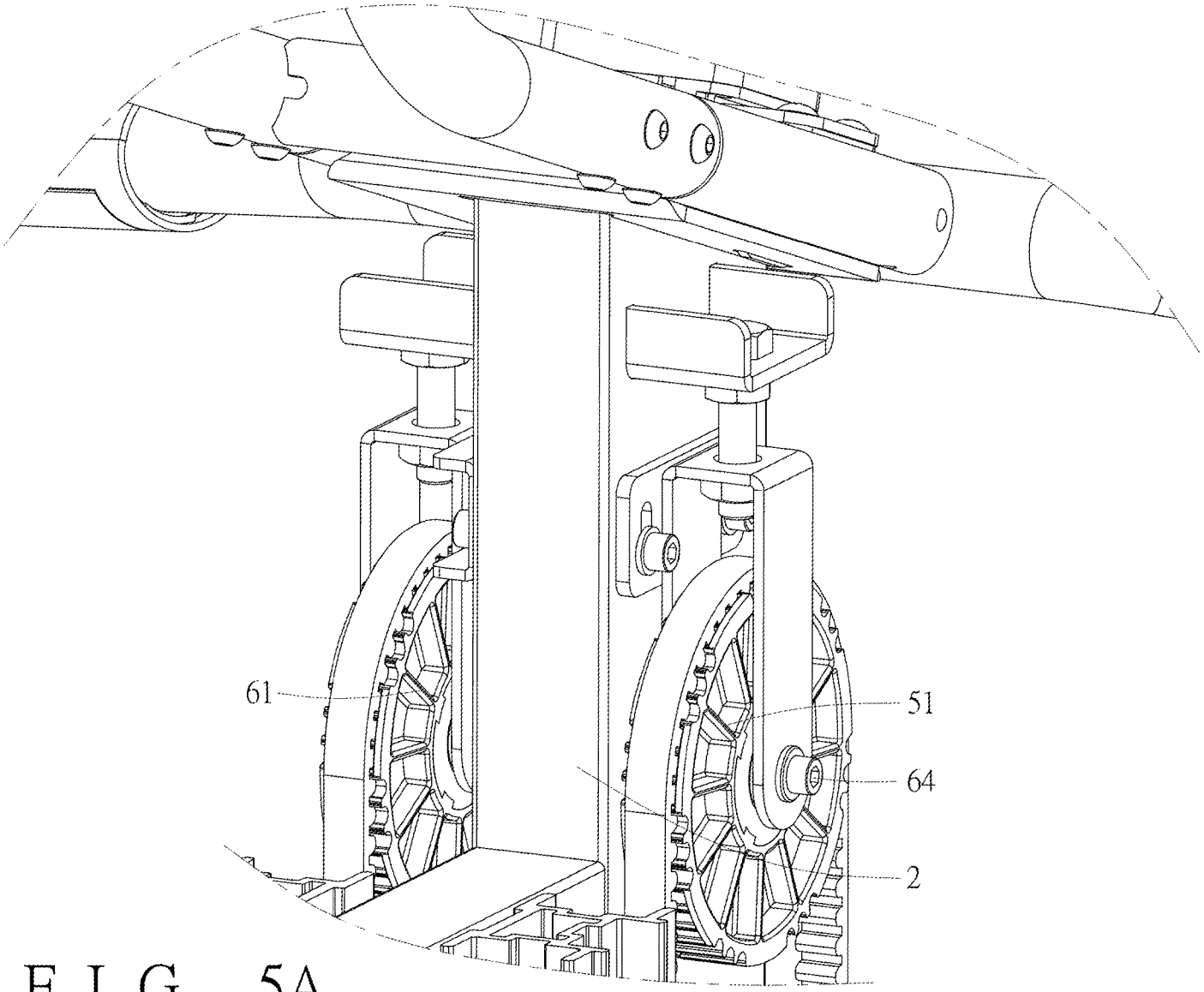
FIG. 5A is a schematic view of the first upper transmission wheel and the second upper transmission wheel disposed at one end of the support frame according to the embodiment of the present invention.

The first transmission unit 5 is disposed on the first side 21. The first transmission unit 5 includes a first upper transmission wheel 51, a first lower transmission wheel 52, and a first transmission member 53 (as shown in FIG. 4 and FIG. 5). The first upper transmission wheel 51 is disposed at one end of the support frame 2 (as shown in FIG. 5A). The first lower transmission wheel 52 is disposed at the other end of the support frame 2. The first transmission member 53 is looped around the first upper transmission wheel 51 and the first lower transmission wheel 52. The first upper transmission wheel 51 and the first lower transmission wheel 52 each are a timing belt pulley, a gear, a belt pulley or a cable wheel. In this embodiment, a timing belt pulley is taken as an example. The first lower transmission wheel 52 drives the first upper transmission wheel 51 to rotate back and forth synchronously through the first transmission member 53.

Figure 6:
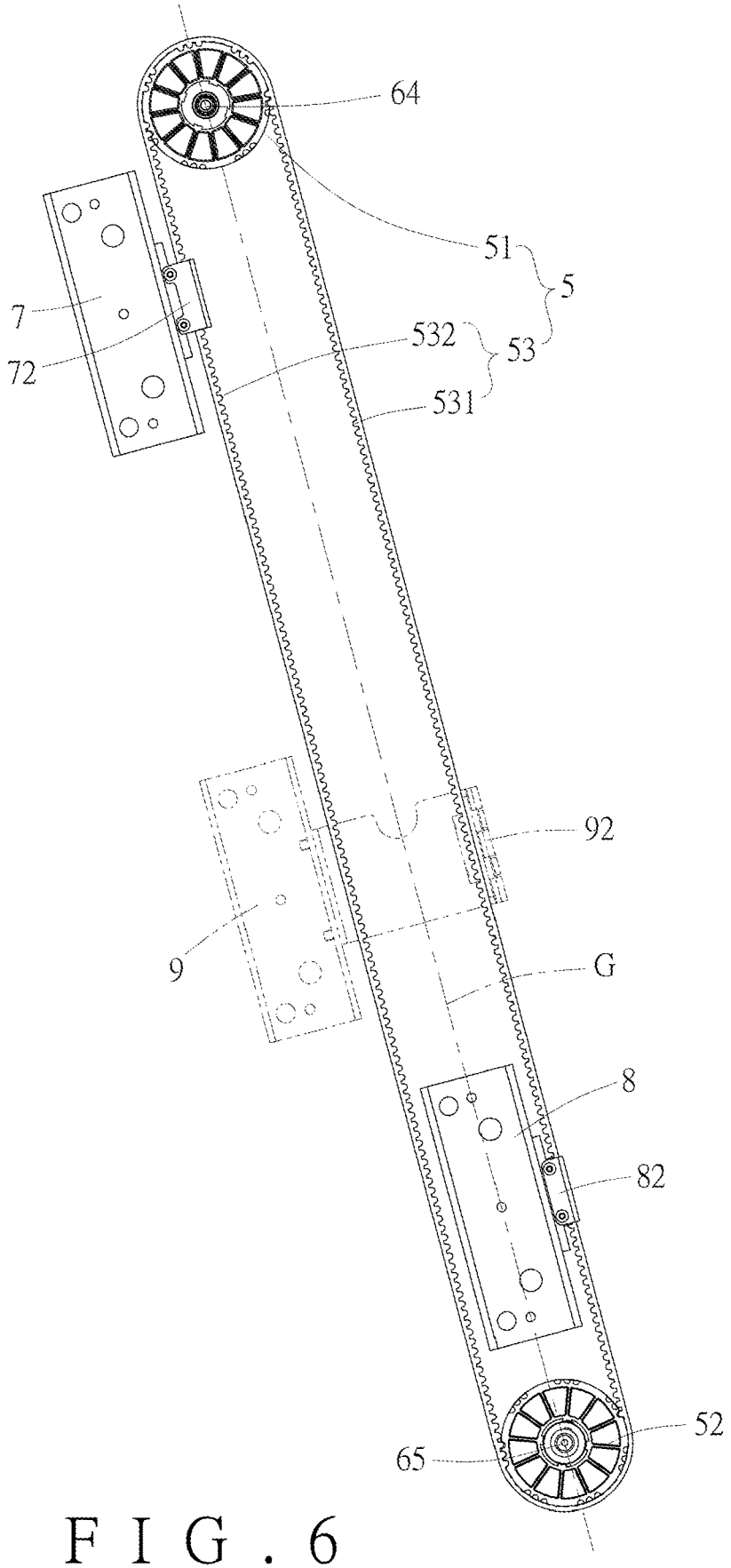
FIG. 6 is a schematic view of the first transmission member being divided into the first near section and the first far section by the axis line according to the embodiment of the present invention.
Figure 7:
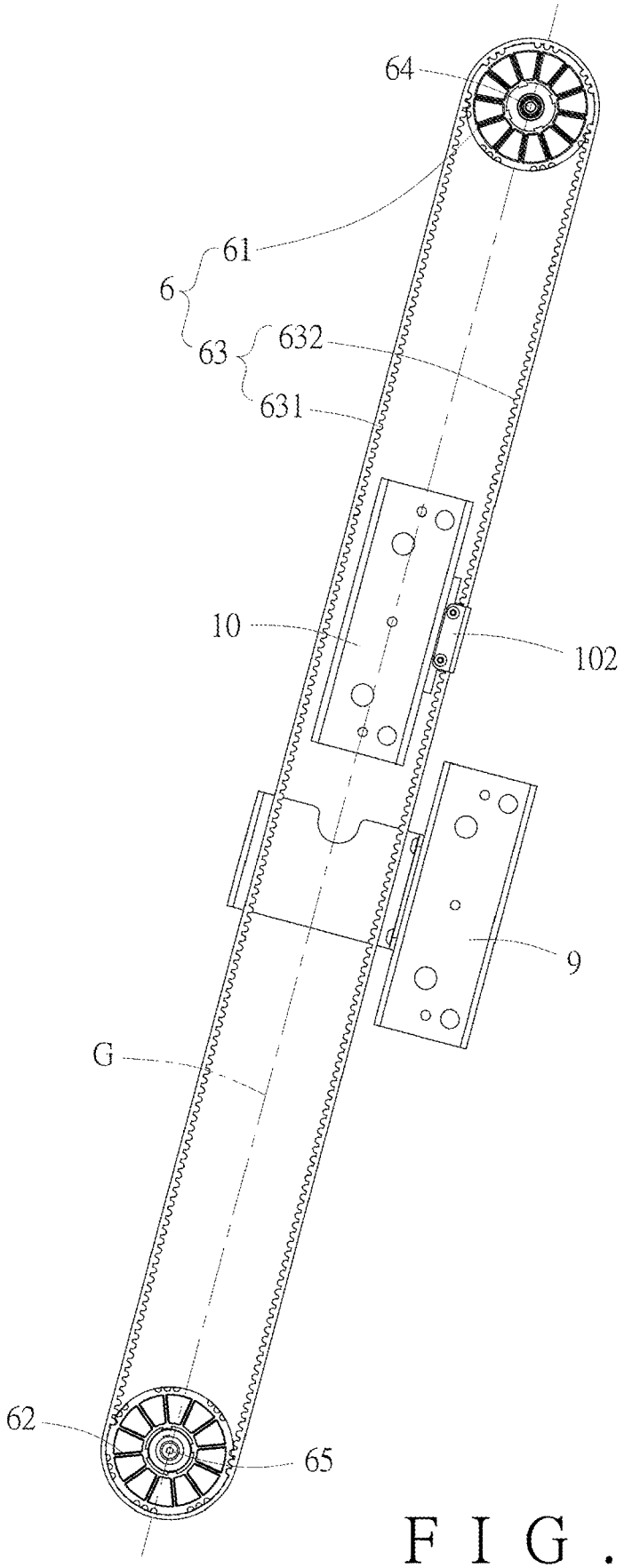
FIG. 7 is a schematic view of the second transmission member being divided into the second near section and the second far section by the axis line according to the embodiment of the present invention.
Figure 13:
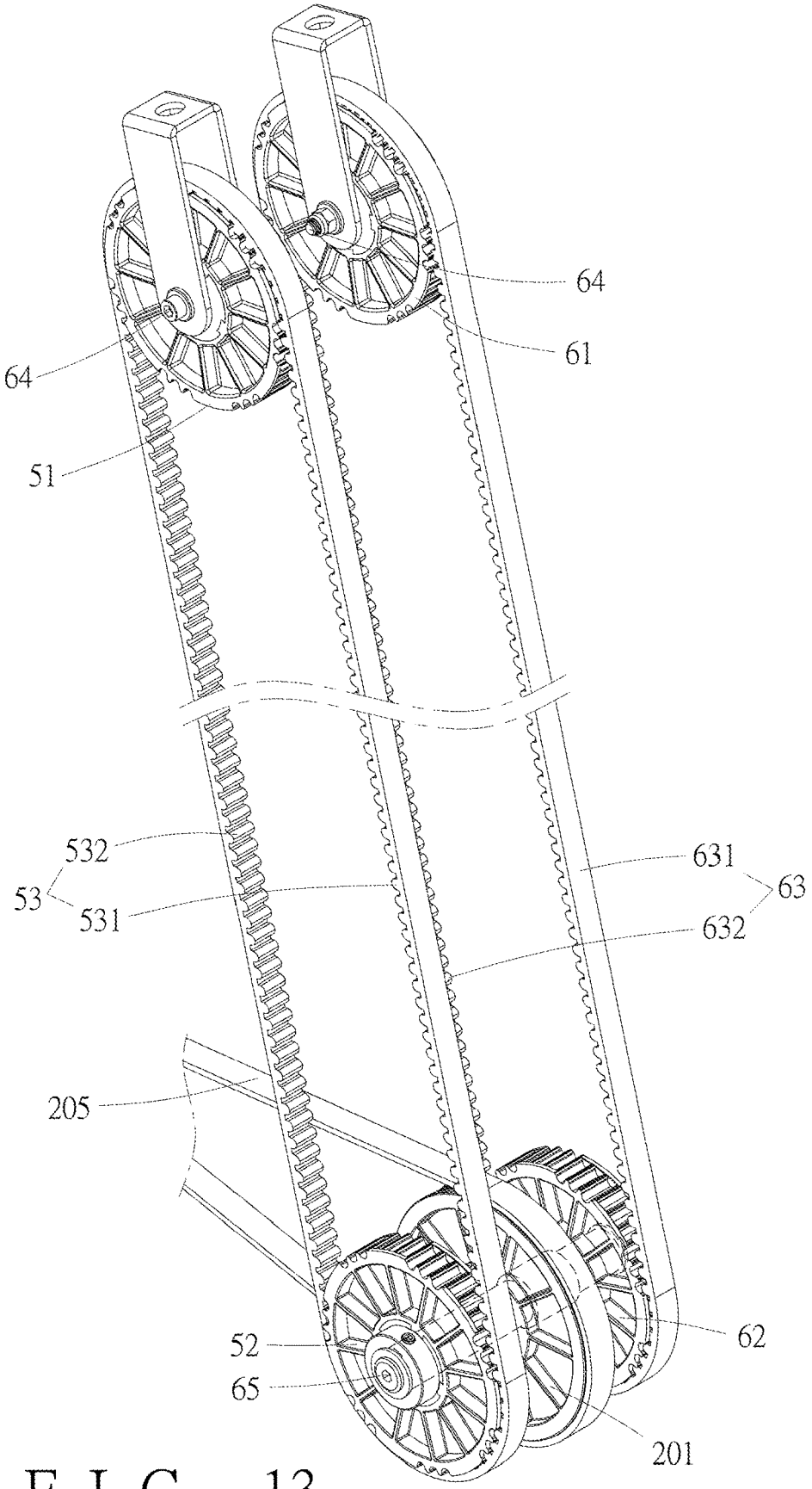
FIG. 13 is a schematic view of the first upper transmission wheel and the second upper transmission wheel that are connected to two upper shafts respectively and the first lower transmission wheel and the second lower transmission wheel that are jointly connected to one lower shaft according to the embodiment of the present invention.

The second transmission unit 6 is disposed on the second side 22. The second transmission unit 6 includes a second upper transmission wheel 61, a second lower transmission wheel 62, and a second transmission member 63 (as shown in FIG. 4 and FIG. 5). The second upper transmission wheel 61 is disposed at one end of the support frame 2 (as shown in FIG. 5A). The second lower transmission wheel 62 is disposed at the other end of the support frame 2. The second transmission member 63 is looped around the second upper transmission wheel 61 and the second lower transmission wheel 62. The second upper transmission wheel 61 and the second lower transmission wheel 62 each are a timing belt pulley, a gear, a belt pulley or a cable wheel. In this embodiment, a timing belt pulley is taken as an example. The second transmission member 63 is a timing belt, a chain, a belt or a cable. In this embodiment, a timing belt is taken as an example. As shown in FIG. 1 and FIG. 13 (wherein the support frame 2 is not shown in FIG. 13), the first upper transmission wheel 51 and the second upper transmission wheel 61 are connected to two upper shafts 64, respectively. The two upper shafts 64 are connected to the support frame 2. The first upper transmission wheel 51 and the second upper transmission wheel 61 are rotatably disposed on the two upper shafts 64, respectively. In addition to this embodiment, the two upper shafts 64 may be replaced by a single upper shaft. The first upper transmission wheel 51 and the second upper transmission wheel 61 are rotatably disposed on the single shaft. The first lower transmission wheel 52 and the second lower transmission wheel 62 are jointly connected to a lower shaft 65. The lower shaft 65 is rotatably connected to the support frame 2, so that the first lower transmission wheel 52 and the second lower transmission wheel 62 are rotated back and forth synchronously along with the lower shaft 65. The first lower transmission wheel 52 drives the first upper transmission wheel 51 to rotate back and forth synchronously through the first transmission member 53. The second lower transmission wheel 62 drives the second upper transmission wheel 61 to rotate back and forth synchronously through the second transmission member 63. As shown in FIG. 6 and FIG. 7, an axis line G between an upper shaft axis of the upper shaft 64 and a lower shaft axis of the lower shaft 65 divides the first transmission member 53 into a first near section 531 close to the operator F and a first far section 532 away from the operator F. The axis line G divides the second transmission member 63 into a second near section 631 close to the operator F and a second far section 632 away from the operator F.

Please refer to FIG. 1, FIG. 2, FIG. 6 and FIG. 8. A first handle 71 is connected to the first handle slider 7. The first handle slider 7 is provided with a first handle connecting block 72. The first handle connecting block 72 is connected to the first far section 532 of the first transmission member 53 (as shown in FIG. 6). The first far section 532 drives the first handle slider 7 to slide on the first far slide rail 32 of the first slide rail 3. The first handle slider 7 drives the first handle 71 to move synchronously. In addition, the first handle 71 extends upward to form a first handle upper section 73. The first handle upper section 73 is provided with a first grip 74.

Figure 8:
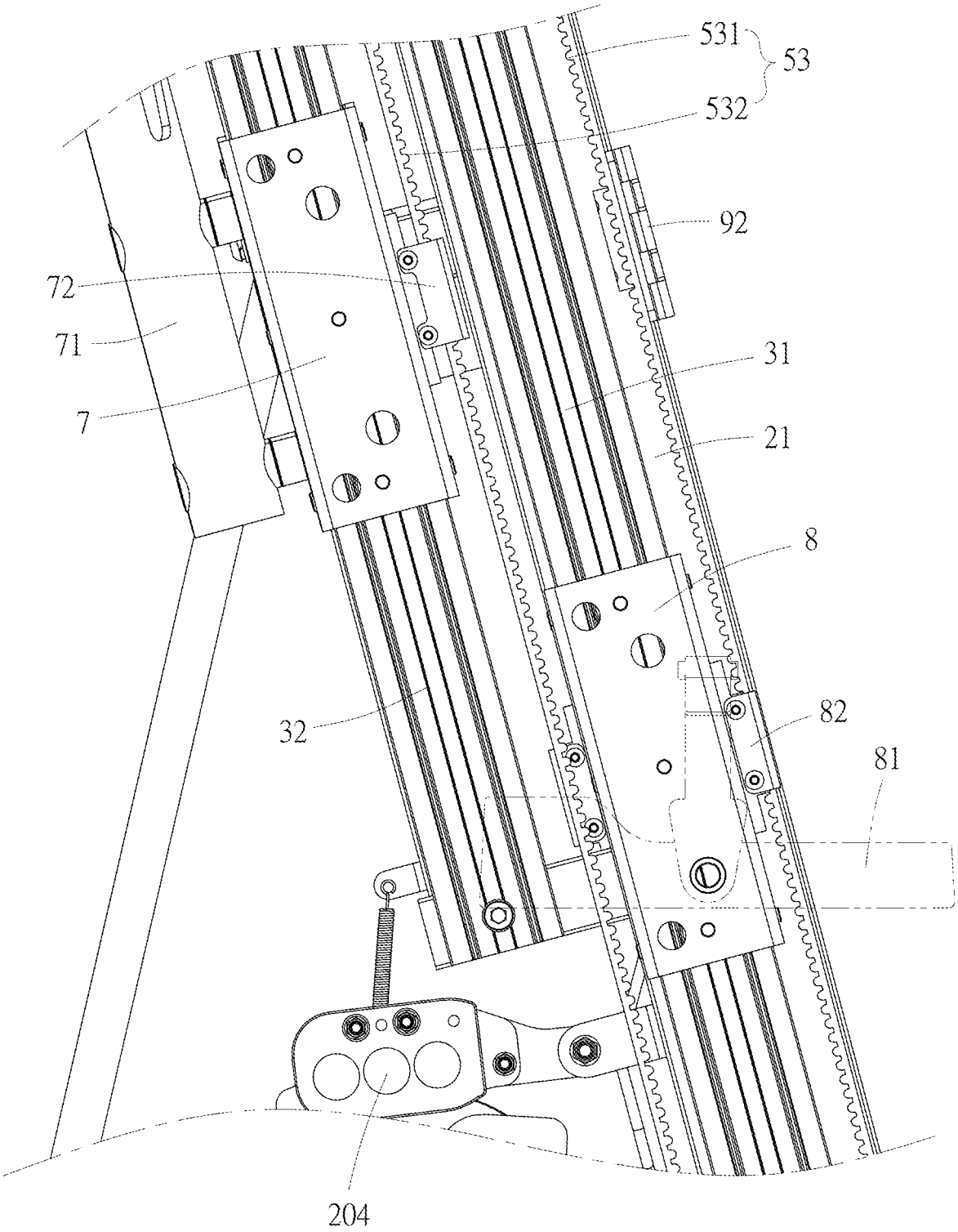
FIG. 8 is a schematic view of the first handle slider and the first pedal slider sliding on the first slide rail according to the embodiment of the present invention.

A first pedal 81 is connected to the first pedal slider 8. The first pedal slider 8 is provided with a first pedal connecting block 82. The first pedal connecting block 82 is connected to the first near section 531 of the first transmission member 53 (as shown in FIG. 8). The first near section 531 drives the first pedal slider 8 to slide on the first near slide rail 31 of the first slide rail 3. The first pedal slider 8 drives the first pedal 81 to move synchronously.

Figure 9:
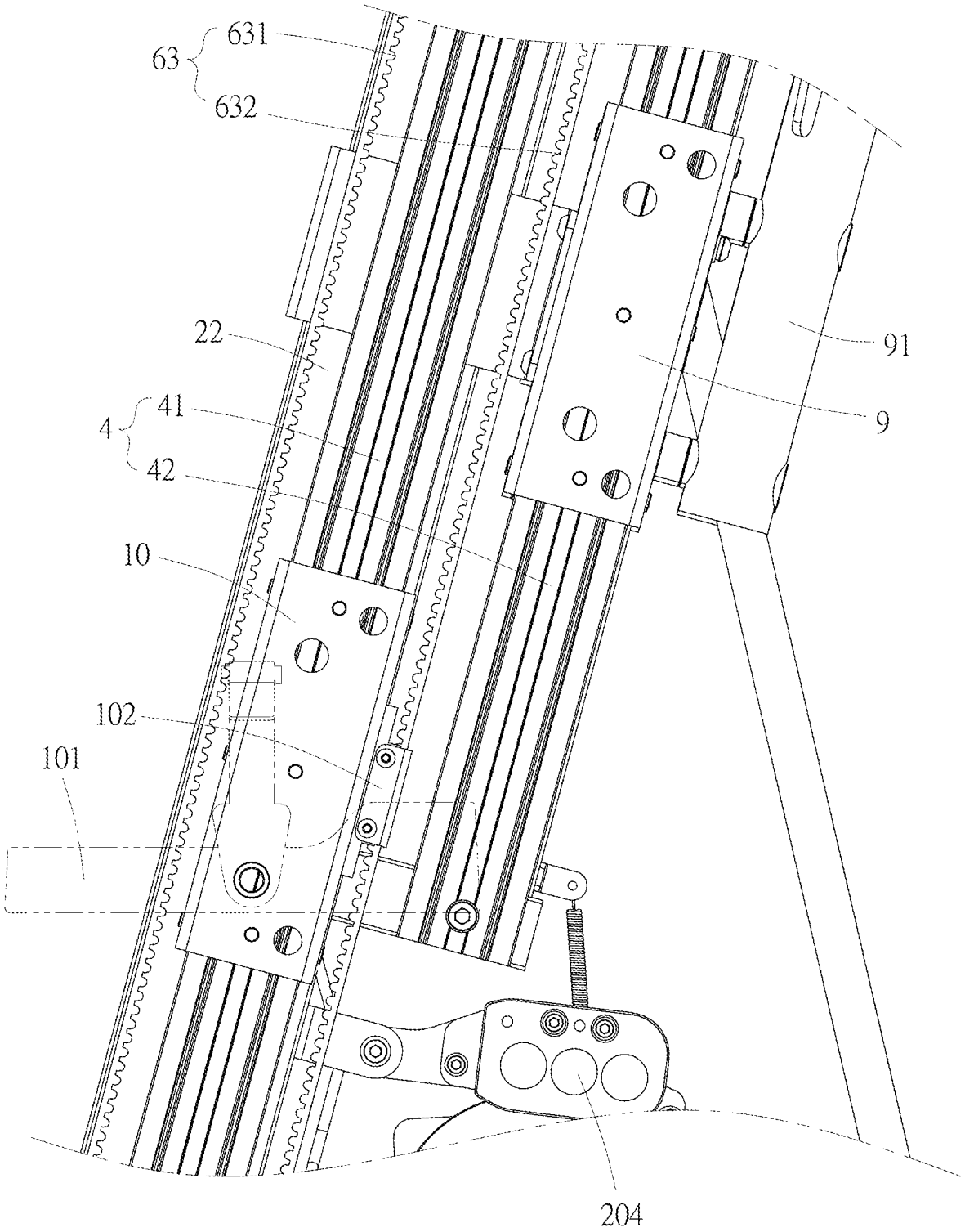
FIG. 9 is a schematic view of the second handle slider and the second pedal slider sliding on the second slide rail according to the embodiment of the present invention.
Figure 10:
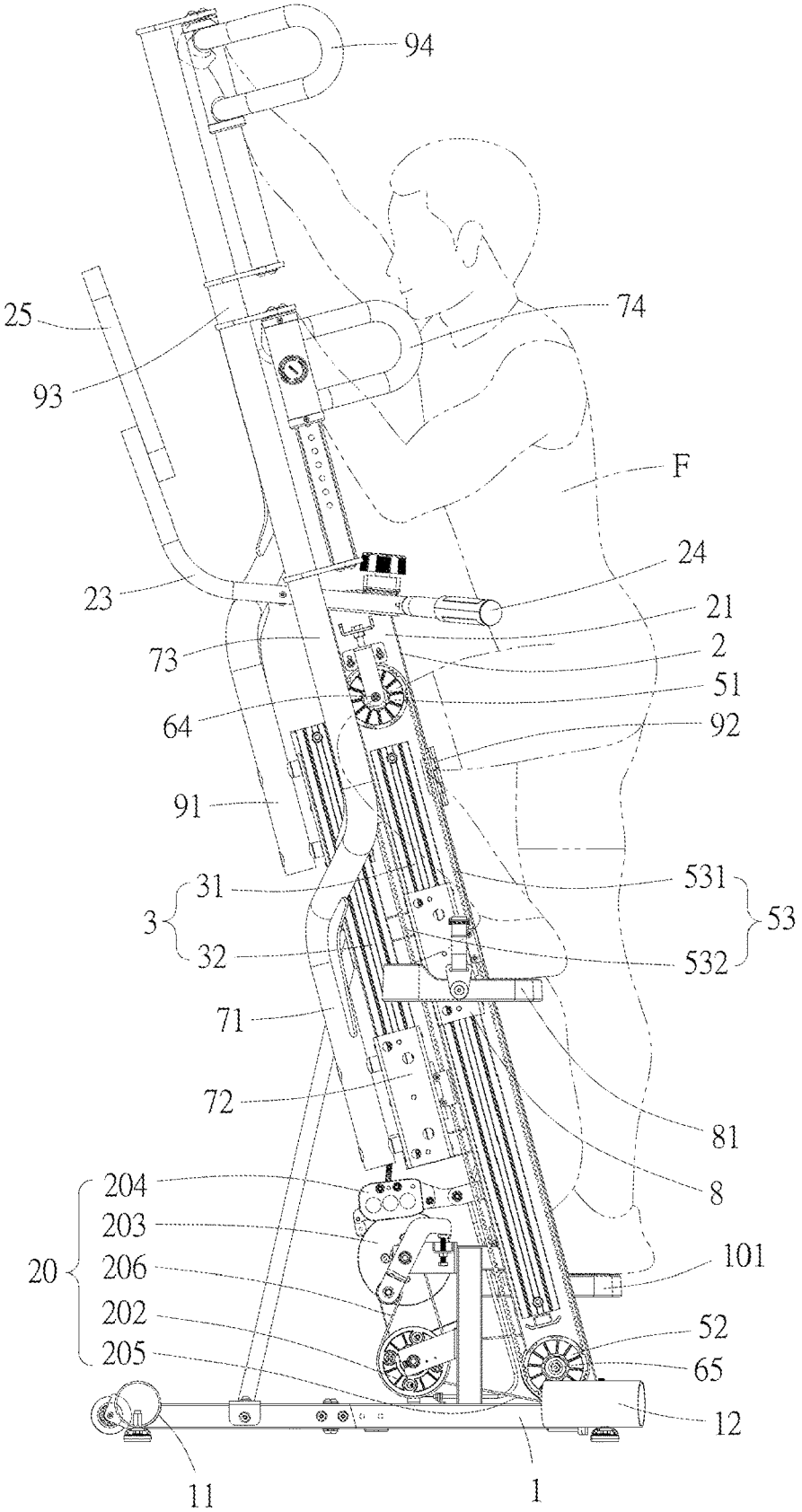
FIG. 10 is a schematic view of the first handle and the first pedal sliding up and down on the first slide rail according to the embodiment of the present invention.
Figure 11:
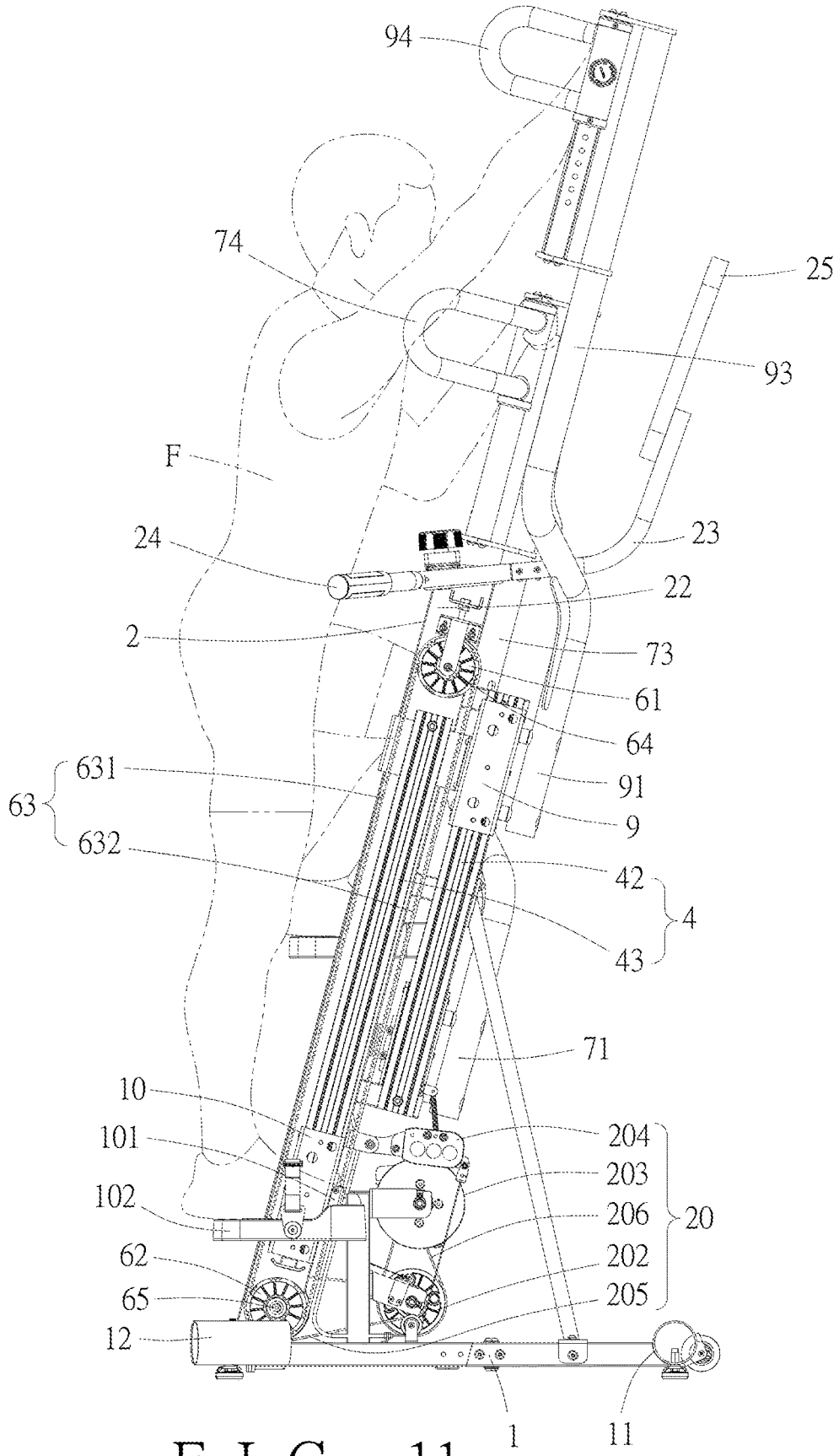
FIG. 11 is a schematic view of the second handle and the second pedal sliding up and down on the second slide rail according to the embodiment of the present invention.

Please refer to FIG. 1, FIG. 3, FIG. 7, FIG. 8 and FIG. 9. A second handle 91 is connected to the second handle slider 9. The second handle slider 9 is provided with a second handle connecting block 92. The second handle connecting block 92 surrounds the support frame 2 from the second side 22 to the first side 21 (as shown in FIG. 8 and FIG. 9) and is connected to the first near section 531 of the first transmission member 53. The first near section 531 drives the second handle slider 9 to slide on the second far slide rail 42 of the second slide rail 4. The second handle slider 9 drives the second handle 91 to move synchronously. The second handle 91 extends upward to form a second handle upper section 93. The second handle upper section 93 is provided with a second grip 94. As shown in FIG. 1, the distance L between the first handle upper section 73 and the second handle upper section 93 is greater than the width W of the display unit 25, which is beneficial for the operator F to view the display unit 25.

A second pedal 101 is connected to the second pedal slider 10. The second pedal slider 10 is provided with a second pedal connecting block 102. The second pedal connecting block 102 is connected to the second far section 632 of the second transmission member 63 (as shown in FIG. 9). The second far section 632 drives the second pedal slider 10 to slide on the second near slide rail 41 of the second slide rail 4. The second pedal slider 10 drives the second pedal 101 to move synchronously.

Referring to FIG. 4 and FIG. 13, the resistance unit 20 is disposed on the base 1 or the support frame 2, and is connected to the first transmission unit 5 or/and the second transmission unit 6. In this embodiment, the resistance unit 20 is disposed between the base 1 and the support frame 2. The resistance unit 20 is connected to the first transmission unit 5 and the second transmission unit 6, so as to provide a resistance to the first transmission unit 5 and the second transmission unit 6. The resistance unit 20 includes a driving wheel 201, a driven wheel 202, a resistance wheel 203, a magnetic resistance member 204, a first belt 205, and a second belt 206. The driving wheel 201 is connected to the lower shaft 65 and rotates back and forth synchronously along with the lower shaft 65. The driven wheel 202 and the resistance wheel 203 are relatively connected to the base 1. The first belt 205 is looped around the driving wheel 201 and the driven wheel 202. The second belt 206 is looped around the driven wheel 202 and the resistance wheel 203. The magnetic resistance member 204 is pivotally connected to the support frame 2. The magnetic resistance member 204 can rotate relative to the resistance wheel 203 at a limited angle, thereby changing the magnetic force acting on the resistance wheel 203, so that the resistance wheel 203 can obtain a variable resistance. The resistance wheel 203 transmits the resistance through the second belt 206, the driven wheel 202, the first belt 205 and the driving wheel 201. The resistance is transmitted to the first handle 71 of the first handle slider 7, the first pedal 81 of the first pedal slider 8, the second handle 91 of the second handle slider 9 and the second pedal 101 of the second pedal slider 10 through the first transmission member 53 and the second transmission member 63.

When in use, as shown in FIG. 2, FIG. 3 and FIG. 13, the left foot of the operator F is placed on the first pedal 81 to exert force, the right foot is placed on the second pedal 101 to exert force, the left hand holds the first grip 74 or the auxiliary handle 24, and the right hand holds the second grip 94 or the auxiliary handle 24. In operation, the left foot and the right foot of the operator F continuously and alternately tread the first and second pedals 81, 101. Because the driving wheel 201, the first lower transmission wheel 52 and the second lower transmission wheel 62 are all connected to the lower shaft 65, they are rotated synchronously. The synchronous rotation is limited continuous rotation back and forth in opposite directions, rather than continuous rotation in the same direction. When the left foot and the right foot of the operator F continuously and alternately tread the first and second pedals 81, 101, the back and forth stroke of the first pedal 81 will drive the first transmission member 53 to rotate back and forth; the back and forth stroke of the second pedal 101 will drive the second transmission member 63 to rotate back and forth.

Please refer to FIG. 1, FIG. 2, FIG. 6 and FIG. 10. The first pedal slider 8 is connected to the first near section 531 of the first transmission member 53, and the second handle slider 9 is also connected to the first near section 531 of the first transmission member 53. When the left foot of the operator F treads down, the first near section 531 will drive the first pedal slider 8 and the second handle slider 9 to move down synchronously, that is, the left foot and the right hand of the operator F move down synchronously. At this time, the first far section 532 drives the first handle slider 7 to move up, so that the left foot and the left hand of the operator F move away from each other in opposite directions. Please refer to FIG. 1, FIG. 2 and FIG. 7. Because the first transmission member 53 and the second transmission member 63 are rotated synchronously in the same direction, when the operator F treads down with his/her left foot, the second far section 632 will drive the second pedal slider 10 to move up. Therefore, the right foot of the operator F will move up. At this time, the right foot and the right hand of the operator F will approach each other in opposite directions.

Please refer to FIG. 1, FIG. 3, FIG. 7 and FIG. 11. When the right foot of the operator F treads down, the second far section 632 will drive the second pedal slider 10 to move down. At this time, referring to FIG. 1, FIG. 2 and FIG. 6, the first near section 531 drives the first pedal slider 8 and the second handle slider 9 to move up synchronously, and the first far section 532 drives the first handle slider 7 to move down. That is, when the right foot of the operator F treads down, the left foot of the operator F will move up, and the right foot and the right hand of the operator F will move away from each other in opposite directions, and the left foot and the left hand of the operator F will approach each other in opposite directions.

Please refer to FIG. 2, FIG. 3, FIG. 6, FIG. 7 and FIG. 13. The first handle slider 7 and the first pedal slider 8 are connected to the first transmission unit 5, and are located on the first side 21 of the support frame 2. The second handle slider 9 is connected to the first transmission unit 5, and the second pedal slider 10 is connected to the second transmission unit 6. The second handle slider 9 and the second pedal slider 10 are located on the second side 22 of the support frame 2. The left foot of the operator F exerts force on the first transmission unit 5, and the right foot of the operator F exerts force on the second transmission unit 6, so that the force applied to the first side 21 and the second side 22 is balanced, providing a stable operation effect. The first pedal slider 8 is connected to the first near section 531 of the first transmission member 53, and the first handle slider 7 is connected to the first far section 532, so that the left foot and the left hand of the operator move away from each other or approach each other in operation. The second pedal slider 10 is connected to the second far section 632 of the second transmission member 63, and the second handle slider 9 is connected to the first near section 531 of the first transmission member 53, so that the right foot and the right hand of the operator move away from each other or approach each other in operation. The first lower transmission wheel 52 and the second lower transmission wheel 62 are connected to the lower shaft 65, so that the three synchronously rotate back and forth. When the left foot of the operator F treads down, the first pedal slider 8 will drive the first near section 531 to move down, so that the second near section 631 also moves down synchronously. At this time, the first far section 532 moves up, and the second far section 632 moves up synchronously. When the right foot of the operator F treads down, the second pedal slider 10 will drive the second far section 632 to move down, so that the first far section 532 also moves down synchronously. At this time, the second near section 631 moves up, and the first near section 531 also moves up synchronously. With the synchronous transmission of the first lower transmission wheel 52 and the second lower transmission wheel 62, the left foot and the right hand of the operator F move up and down synchronously, and the right foot and the left hand move up and down synchronously, so as to conform to the body movements when climbing. The support frame 2, the first slide rail 3, the second slide rail 4, the first transmission unit 5 and the second transmission unit 6 of the present invention are all located at both sides of the center line of the upright trunk of the operator F and located between the legs of the operator F. The volume of the climbing machine can be reduced greatly to save the space occupied.

As shown in FIG. 5, the first transmission member 53 and the second transmission member 63 are timing belts. The first upper transmission wheel 51, the second upper transmission wheel 61, the first lower transmission wheel 52 and the second lower transmission wheel 62 are timing belt pulleys. Through the meshing transmission of the timing belt and the timing belt pulley, the transmission accuracy can be achieved. In addition, the operation process is stable, without slippage and vibration. It is quiet and low-noise, with accurate transmission effect and better power transmission efficiency.

Figure 12:
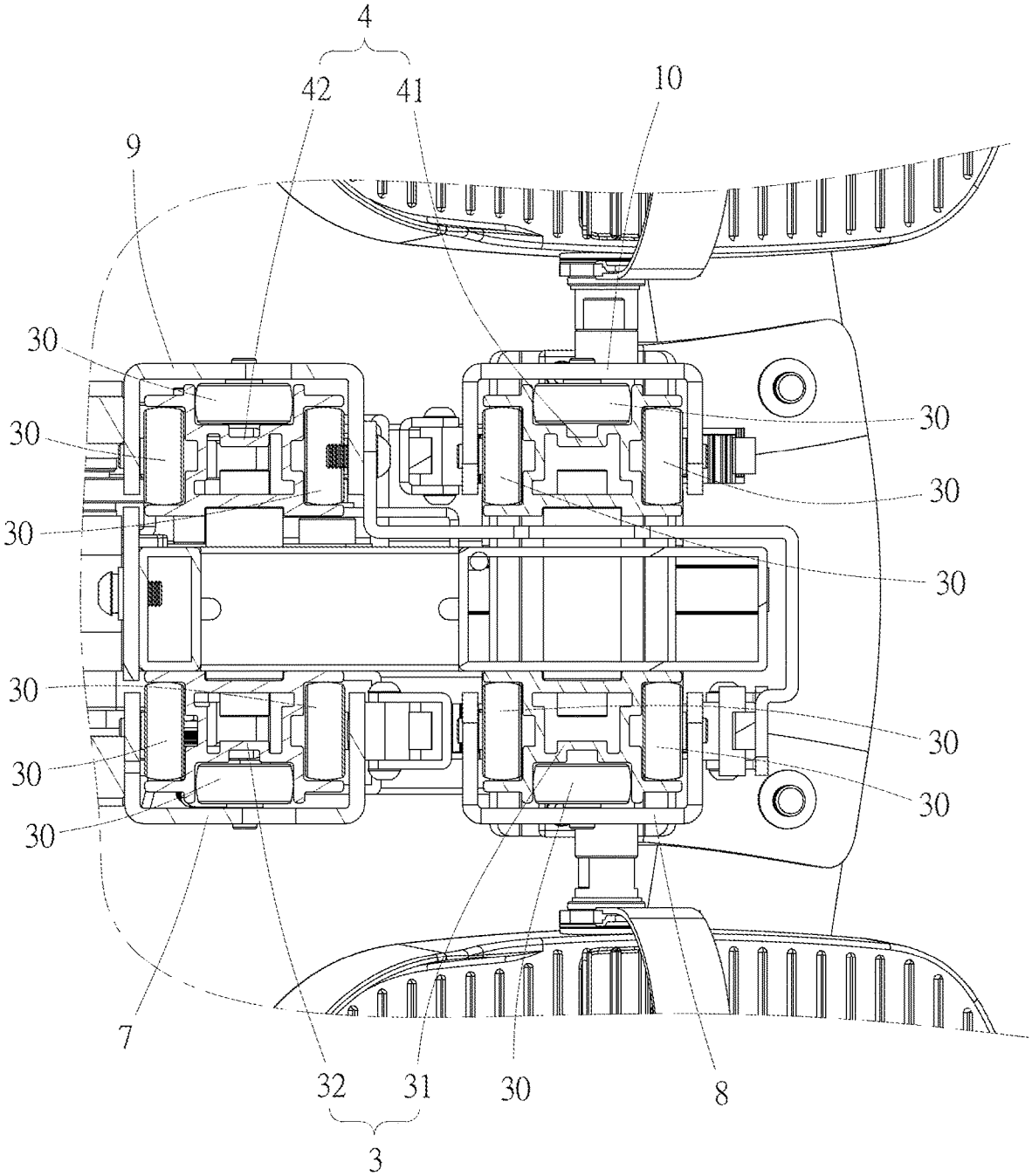
FIG. 12 is a cross-sectional view taken along line XII-XII of FIG. 1.

As shown in FIG. 12, the inner edges of the first handle slider 7, the first pedal slider 8, the second handle slider 9 and the second pedal slider 10 are provided with at least one roller 30. The rollers 30 slide on the first near slide rail 31 and the first far slide rail 32 of the first slide rail 3 and the second near slide rail 41 and the second far slide rail 42 of the second slide rail 4 respectively, thereby reducing resistance and noise during sliding.

Figure 14:
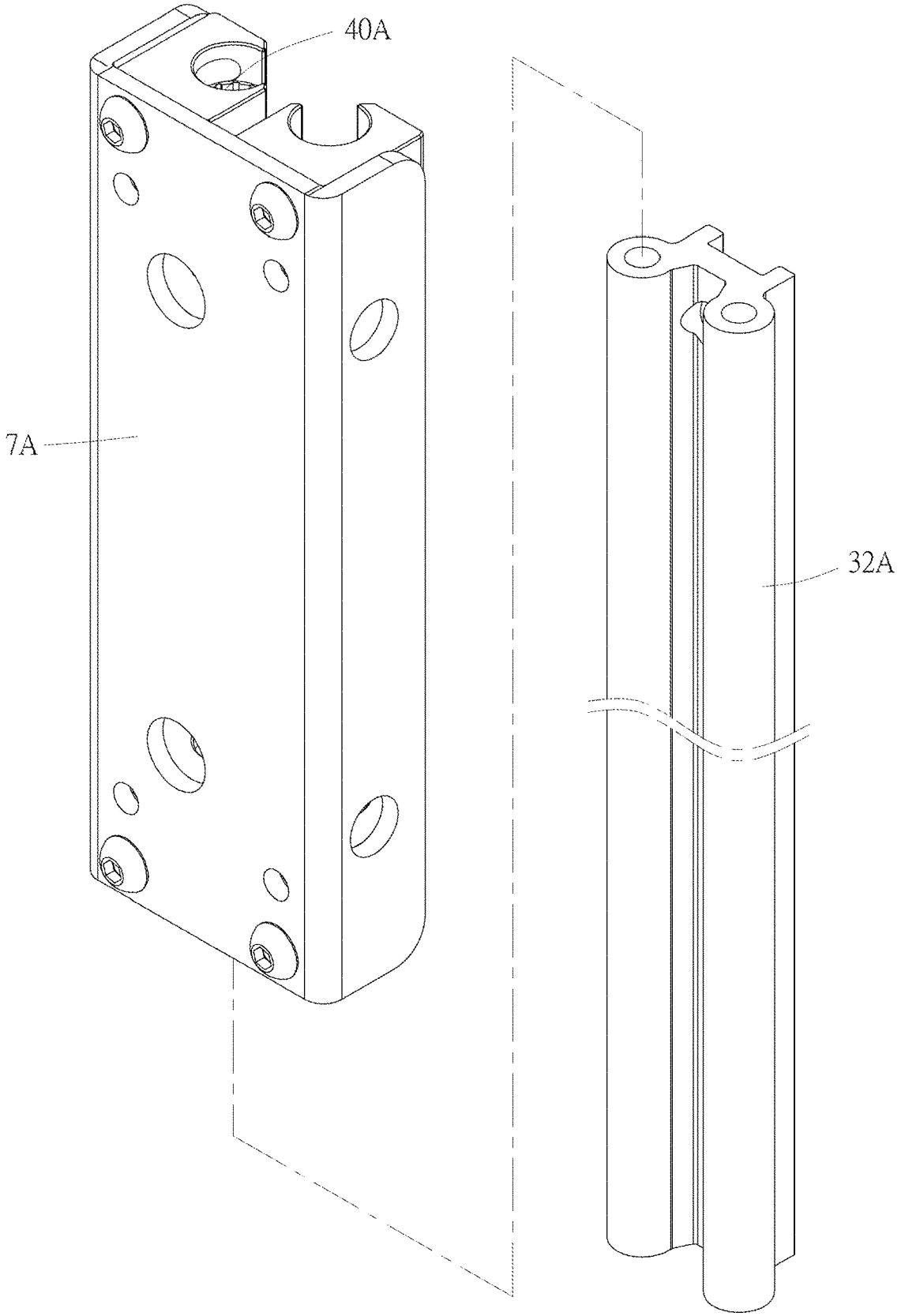
FIG. 14 is an exploded perspective view of another embodiment of the present invention.
Figure 15:
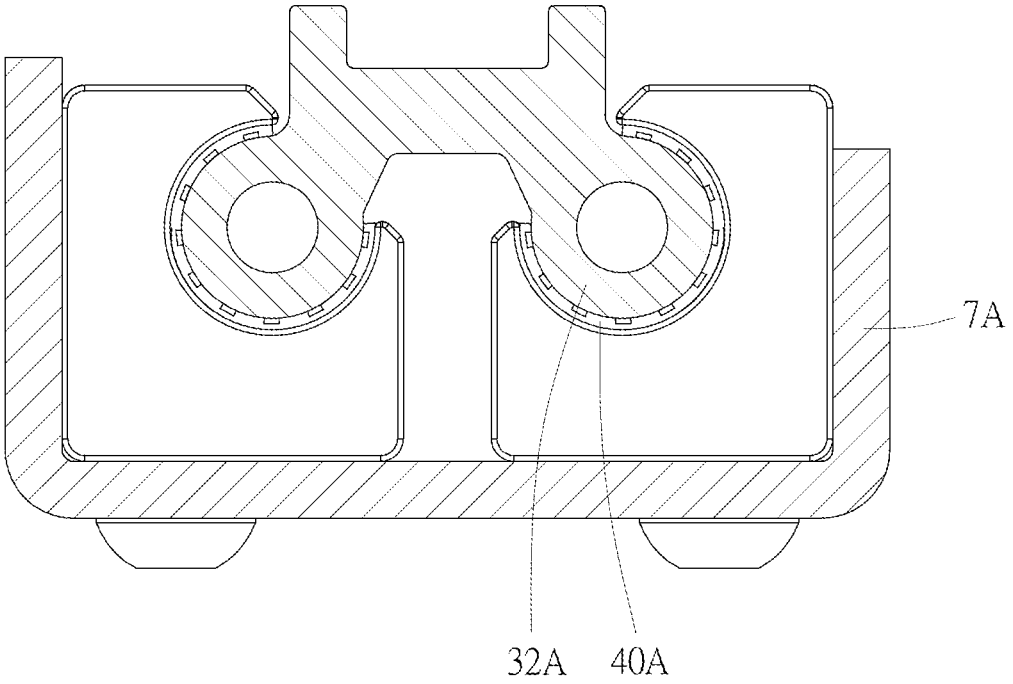
FIG. 15 is a cross-sectional view of another embodiment of the present invention.

FIG. 14 and FIG. 15 illustrate another embodiment of the present invention. The roller 30 is replaced by a bushing 40A, and a first far slide rail 32A corresponds in shape to the bushing 40A, so that the bushing 40A is fitted on the first far slide rail 32A to slide thereon. The inner edges of the first handle slider 7A, the first pedal slider, the second handle slider and the second pedal slider (not shown) are provided with at least one bushing 40A. The bushings 40A slide on the first near slide rail (not shown) and the first far slide rail 32A of the first slide rail and the second near slide rail (not shown) and the second far slide rail (not shown) of the second slide rail respectively, thereby reducing noise during sliding.

The rollers 30, the first near slide rail 31, the first far slide rail 32, the second near slide rail 41 and the second far slide rail 42 of the "roller type slide rail" as shown in FIG. 12 and the bushings 40A, the first near slide rail (not shown), the first far slide rail 32A, the second near slide rail and the second far slide rail of the "sliding type slide rail" as shown in FIG. 14 and FIG. 15 are all feasible embodiments of the present invention. Of course, it is also a feasible embodiment of the present invention to use the above-mentioned "roller-type slide rail" and "sliding-type slide rail" in combination.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A transmission structure of a climbing machine for an operator to operate in a standing position, comprising:

a base;

a support frame, vertically disposed on the base, the support frame configured to be located between both legs of the operator, the support frame including a first side and a second side;

a first slide rail, disposed on the first side;

a second slide rail, disposed on the second side;

a first transmission unit, disposed on the first side, the first transmission unit including a first upper transmission wheel, a first lower transmission wheel and a first transmission member, the first upper transmission wheel being disposed at one end of the support frame, the first lower transmission wheel being disposed at another end of the support frame, the first transmission member being looped around the first upper transmission wheel and the first lower transmission wheel, the first transmission member including a first near section configured to be close to the operator and a first far section configured to be away from the operator;

a second transmission unit, disposed on the second side, the second transmission unit including a second upper transmission wheel, a second lower transmission wheel and a second transmission member, the second upper transmission wheel corresponding to the first upper transmission wheel and being disposed at one end of the support frame, the second lower transmission wheel corresponding to the first lower transmission wheel and being disposed at the other end of the support frame, the second transmission member being looped around the second upper transmission wheel and the second lower transmission wheel, the second transmission member including a second near section configured to be close to the operator and a second far section configured to be away from the operator, the first transmission unit and the second transmission unit acting synchronously, the first transmission member and the second transmission member each is a timing belt, a chain, a belt or a cable;

a first handle slider, a first handle being connected to the first handle slider, the first handle slider being configured to slide on the first slide rail, the first handle slider being connected to the first far section;

a first pedal slider, a first pedal being connected to the first pedal slider, the first pedal slider being configured to slide on the first slide rail, the first pedal slider being connected to the first near section;

a second handle slider, a second handle being connected to the second handle slider, the second handle slider being configured to slide on the second slide rail, the second handle slider being connected to the first near section;

a second pedal slider, a second pedal being connected to the second pedal slider, the second pedal slider being configured to slide on the second slide rail, the second pedal slider being connected to the second far section;

a resistance unit, disposed on the base or the support frame, the resistance unit being connected to the first transmission unit or/and the second transmission unit for providing a resistance to the first transmission unit or/and the second transmission unit, the resistance unit includes a driving wheel, a driven wheel, a resistance wheel, a magnetic resistance member, a first belt and a second belt, the driving wheel is connected to the lower shaft and rotates back and forth synchronously along with the lower shaft, the driven wheel and the resistance wheel are relatively connected to the base, the first belt is looped around the driving wheel and the driven wheel, the second belt is looped around the driven wheel and the resistance wheel, the magnetic resistance member is rotatably disposed on the support frame to exert the resistance on the resistance wheel, the resistance wheel transmits the resistance through the second belt, the driven wheel, the first belt and the driving wheel, and the resistance is transmitted to the first handle, the first pedal, the second handle, and the second pedal through the first transmission member and the second transmission member.

2. The transmission structure of the climbing machine as claimed in claim 1, wherein the first upper transmission wheel, the first lower transmission wheel, the second upper transmission wheel and the second lower transmission wheel each is a timing belt pulley, a gear, a belt pulley or a cable wheel.

3. The transmission structure of the climbing machine as claimed in claim 1, wherein the first slide rail includes a first near slide rail and a first far slide rail, the first near slide rail is arranged on the support frame at a position close to the operator, the first pedal slider slides on the first near slide rail, the first far slide rail is configured to be arranged on the support frame at a position away from the operator, the first handle slider slides on the first far slide rail, the second slide rail includes a second near slide rail and a second far slide rail, the second near slide rail is configured to be arranged on the support frame at a position close to the operator, the second pedal slider slides on the second near slide rail, the second far slide rail is configured to be arranged on the support frame at a position away from the operator, and the second handle slider slides on the second far slide rail.

4. The transmission structure of the climbing machine as claimed in claim 1, wherein the first handle slider is provided with a first handle connecting block, the first handle connecting block is connected to the first far section, the first pedal slider is provided with a first pedal connecting block, the first pedal connecting block is connected to the first near section, the second handle slider is provided with a second handle connecting block, the second handle connecting block is connected to the first near section, and the second pedal slider is provided with a second pedal connecting block, the second pedal connecting block is connected to the second far section.

5. The transmission structure of the climbing machine as claimed in claim 1, wherein the first upper transmission wheel and the second upper transmission wheel are connected to an upper shaft, the upper shaft is connected to the support frame, the first upper transmission wheel and the second upper transmission wheel are rotatably disposed on the upper shaft respectively, the first lower transmission wheel and the second lower transmission wheel are jointly connected to a lower shaft, the lower shaft is rotatably connected to the support frame, so that the first lower transmission wheel and the second lower transmission wheel are rotated back and forth synchronously along with the lower shaft.

6. The transmission structure of the climbing machine as claimed in claim 5, wherein an axis line between an upper shaft axis of the upper shaft and a lower shaft axis of the lower shaft divides the first transmission member into the first near section and the first far section, and the axis line divides the second transmission member into the second near section and the second far section.

7. The transmission structure of the climbing machine as claimed in claim 1, wherein an auxiliary frame is provided at one end of the support frame away from the base, the auxiliary frame is provided with an auxiliary handle configured to be at a position close to the operator, the auxiliary frame is provided with a display unit configured to be at a position away from the operator, the first handle has a first handle upper section, the second handle has a second handle upper section, and a distance between the first handle upper section and the second handle upper section is greater than a width of the display unit.

8. The transmission structure of the climbing machine as claimed in claim 1, wherein the first handle slider, the second handle slider, the first pedal slider and the second pedal slider are respectively provided with at least one roller, and the roller slides on the first slide rail or the second slide rail.

9. The transmission structure of the climbing machine as claimed in claim 1, wherein the first handle slider, the second handle slider, the first pedal slider and the second pedal slider are respectively provided with at least one bushing, and the bushing slides on the first slide rail or the second slide rail.

10. The transmission structure of the climbing machine as claimed in claim 1, wherein the first transmission member and the second transmission member each is a timing belt, a chain, a belt or a cable.

* * * * *